United States Patent [19]

Steiner et al.

[11] 4,254,678

[45] Mar. 10, 1981

[54] SAFETY GUARD FOR FOOD SLICER

[75] Inventors: Robert A. Steiner, Lincolnwood; Robert A. Novy, LaGrange Park, both of Ill.

[73] Assignee: Prince Castle, Inc., Carol Stream, Ill.

[21] Appl. No.: 114,944

[22] Filed: Jan. 23, 1980

[51] Int. Cl.[3] ..... B26D 4/20

[52] U.S. Cl. ..... 83/425.3; 83/437; 83/546; 83/858; 83/DIG. 1

[58] Field of Search ..... 83/425.3, 437, 544–546, 83/858, DIG. 1

[56] References Cited

U.S. PATENT DOCUMENTS

| | | | |
|---|---|---|---|
| 2,120,375 | 6/1938 | Shaver et al. | 83/437 |
| 2,407,924 | 9/1946 | Garfunkel | 83/437 |

*Primary Examiner*—Frank T. Yost

*Attorney, Agent, or Firm*—Emrich, Root, Lee, Brown & Hill

[57] ABSTRACT

The combination in a food slicer of the type embodying a cutter unit, comprising a plurality of spaced cutter blades, and a pusher unit having a plurality of pusher blades that may be manually moved into and out of intermeshed relation to the cutter blades for pressing tomatoes, or the like, through the cutter unit, of a safety guard having a portion movable upwardly and downwardly between a position wherein it is disposed in overlying relation to the cutter blades, between the cutter unit and the pusher unit, and a position wherein it is disposed above the pusher unit, the safety guard having a projecting portion for preventing the pusher blades being damaged by engagement with the safety guard.

8 Claims, 6 Drawing Figures

SAFETY GUARD FOR FOOD SLICER

BACKGROUND OF THE INVENTION

The invention relates to safety guards, and, more particularly, to safety guards for manual food slicers, and the like.

A primary object of the present invention is to afford a novel safety guard for manual food slicers.

Food slicers of the general type to which the present invention pertains have been heretofore known in the art. They commonly embody a base on which is mounted a cutter unit, which includes a plurality of stacked, parallel cutter blades, with a pusher unit having pusher blades that may be manually pushed into and out of intermeshed relation to the cutter blades for pressing food, such as tomatoes, or the like, which have been manually placed between the cutter unit and the pusher unit, through the stack of cutter blades, for thereby slicing the food. The cutter blades in such slicers commonly are so extremely sharp that if the operator accidentally bumps or brushes his hand thereagainst during operation of the slicer, severe lacerations may result. Safety guards have been heretofore known in the art, which were intended to protect against such accidental contact with the cutter blades of such slicers. However, such safety guards heretofore known in the art commonly have had several inherent disadvantages, such as, for example, not being reliable in operation; being complicated in construction or operation; causing problems in the operation of the machine; or being difficult and expensive to manufacture, or the like. It is an important object of the present invention to overcome such disadvantages.

Another object of the present invention is to afford a novel safety guard for such slicers, which affords effective protection against such accidential contact with the cutter blades of the slicer.

Another object of the present invention is to afford a novel safety guard of the aforementioned type which is readily operable.

A further object of the present invention is to afford a novel slicer of the aforementioned type wherein the parts thereof are so constituted and arranged that the guard does not interfere with the desired, normal operation of the slicer, but is effective to prevent damaging contact therewith by the cutter blades.

Another object of the present invention is to afford a novel guard of the aforementioned type which may be readily mounted on such a slicer.

Another object of the present invention is to afford a novel guard of the aforementioned type which is practical and efficient in operation and which may be readily and economically produced commercially.

Other and further objects of the present invention will be apparent from the following description and claims and are illustrated in the accompanying drawings which, by way of illustration, show a preferred embodiment of the present invention and the principles thereof and what we new consider to be the best mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
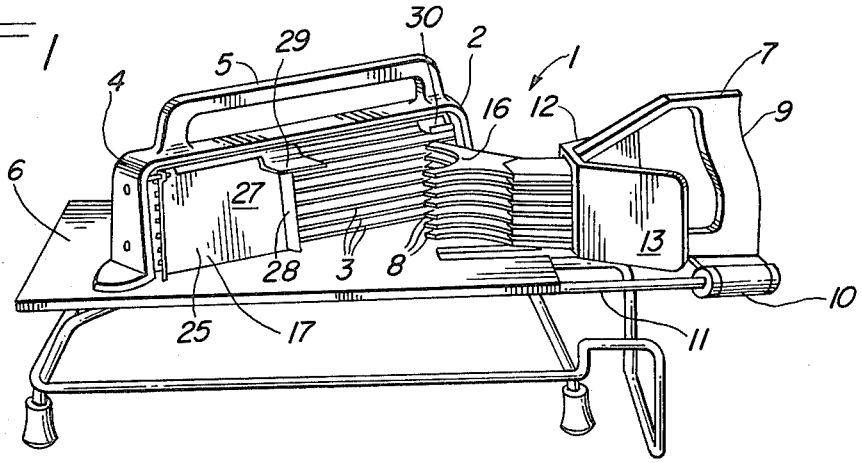
FIG. 1 is a front perspective view of a food slicer having a safety guard, embodying the principles of the present invention, mounted in operative position thereon.

A food slicer 1, embodying the principles of the present invention, is shown in the drawings to illustrate the presently preferred embodiment of the present invention.

The food slicer 1, embodies, in general, a cutter unit 2, which embodies a substantially rectangular-shaped stack of parallel, spaced cutter blades 3 mounted in a supporting frame 4, the supporting frame 4 having a handle 5 projecting upwardly from the top thereof for a purpose which will be discussed in greater detail presently. The cutter unit 2 is disposed in upright position on a suitable supporting base, which, in the preferred form of the food slicer 1 shown in the drawings, is in the form of a substantially rectangular-shaped table 6, of a type well known in the art.

The food slicer 1 also includes a pusher unit 7, which embodies a plurality of elongated, substantially parallel pusher blades 8 disposed rearwardly of and secured to the rear end portion of a handle 9 in substantially parallel, spaced, stacked relation to each other. The pusher unit 7 may be mounted on the base 6 by any suitable means, for reciprocation between a fully withdrawn position relative to the cutter unit 2, as shown in FIG. 1, and a fully inserted position relative to the cutter unit 2, as shown in FIG. 3, but in the preferred form of the invention shown in the drawings, is supported by a pair of cylinders 10 secured to the handle 9 and mounted on respective ones of a pair of elongated rods 11 suspended under the top of the table 6, in a manner well known in the art, FIGS. 1, 2 and 5.

Two guard plates or wings 12 and 13 project outwardly from opposite sides of the rear end portion of the handle 9 at a forwardly opening acute angle thereto. Preferably, the guard plate 12 is disposed in substantially parallel relation to the adjacent front face of the cutter unit 2. As is well known in the art, the guard plates 12 and 13 afford protection against the hand of an operator slipping from the handle 9 and engaging the blades 3 of the cutter unit 2. In addition, the guard plate 12 affords one portion of an effective stop mechanism for preventing improper operation of the food slicer 1, as will be discussed in greater detail hereinafter.

Figure 5:
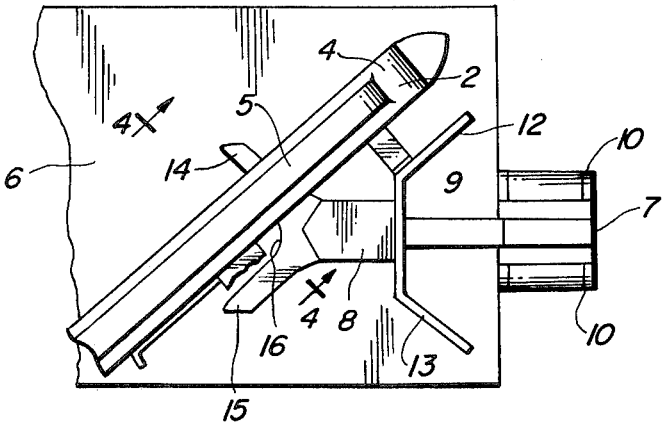
FIG. 5 is a fragmentary top plan view of the slicer shown in FIG. 4.

The pusher blades 8 are of a type well known in the art, and each embodies two fingers 14 and 15 projecting rearwardly from respective opposite sides of a substantially arcuate shaped recess 16 in the rear end portion thereof, FIG. 5. The fingers 14 and 15 are on the sides of the respective pusher blades 8 corresponding to the sides of the pusher unit 7, from which the guard plates 12 and 13 project, respectively. The pusher unit 7 is so disposed on the supporting base 6 that the longitudinal center lines of the elongated pusher blades 8 are disposed at an acute angle to the cutter unit 2, and during operation of the food slicer 1, the blades 8 are moved longitudinally into and out of intermeshed relation to the cutter blades 3 between the positions shown in FIGS. 1 and 3.

Figure 3:
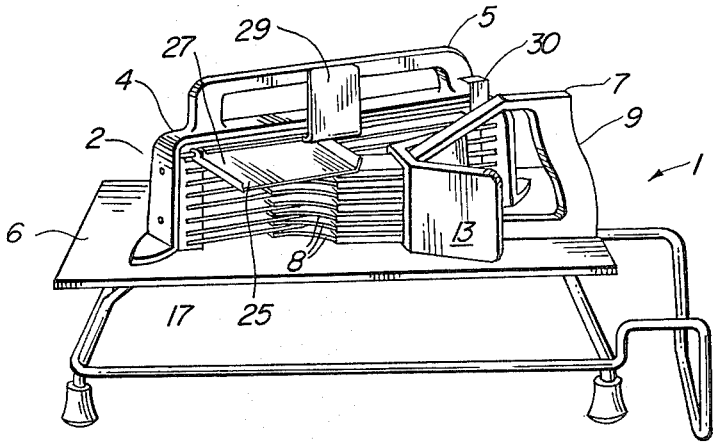
FIG. 3 is a fragmentary, front perspective view, similar to FIG. 2, but showing the parts of the slicer disposed in different operative position.

The food slicer 1 heretofore described, is of a type well known in the art, and, as is well known by those skilled in the art, in the operation thereof food, such as, for example, a tomato is manually placed in the arcuate recesses 16 of the pusher unit 7, while the latter is disposed in forwardly disposed position, as shown in FIG. 1; and the pusher unit 7 is then manually moved from the forwardly disposed position, shown in FIG. 1, to the rearwardly disposed position, shown in FIG. 3, to thereby push the tomato, or the like, through the cutter unit 2, such passage of the tomato through the cutter unit 2 causing the cutter blades 3 thereof to cut the tomato into slices, which fall onto the base 6 rearwardly of the cutter unit 2. As is well known by those skilled in the art, the cutter blades 3 are normally very sharp, commonly having the sharpness of razor blades, so that if an operator merely touches the cutting edges thereof he or she may be severely cut. As a result, various attempts have been made to afford such food slicers with protective devices for guarding against accidental lacerations, including providing the food slicers with flat plates that could be moved upwardly and downwardly out of and into covering relation to the cutter blades of the slicer but these previous attempts have met with only limited success, as will be discussed in greater detail presently.

The food slicer 1, shown in the drawings, embodies a novel safety guard 17. The safety guard 17 embodies an elongated upper edge portion 18, which extends substantially the full length of the rear face of the cutter unit 2, and terminates at its opposite ends in forwardly projecting flanges 19 and 20, which are rotatably attached to the insides of the respective adjacent ends of the supporting frame 4 of the cutter unit 2 by suitable means such as pins 21, FIG. 6. Between the flanges 19 and 20, the upper edge portion 18 of the safety guard 17 embodies a substantially arcuate shaped body portion 22, having a rear flange portion 23 and a front flange portion 24, FIGS. 4 and 6.

Figure 6:
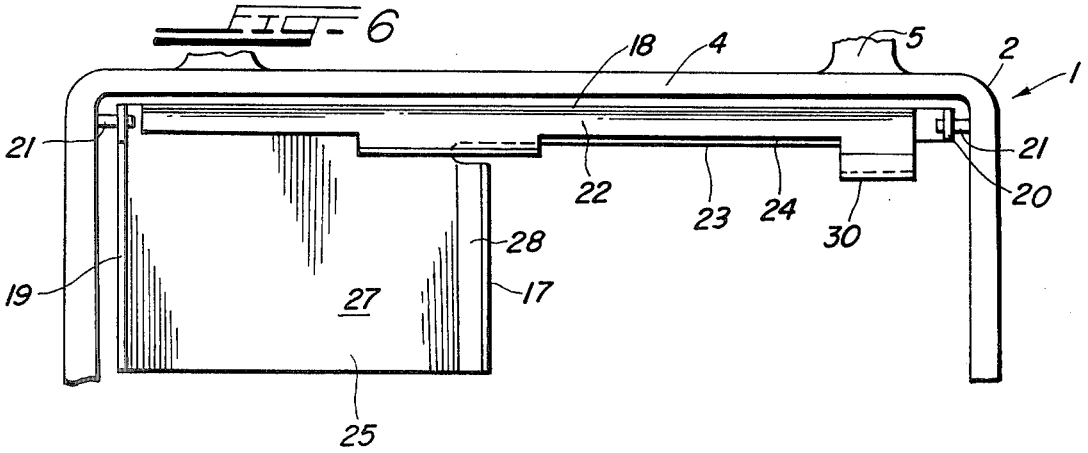
FIG. 6 is a fragmentary front elevational view of the cutter unit, with the safety guard disposed in the lowered position shown in FIG. 1.

A substantially rectangular shaped plate 25 is formed integrally with the flange portion 23 of the main body portion 22 and projects downwardly from the flange portion 23 when the latter is disposed in its normal, at-rest position, FIGS. 1 and 6. Preferably, the plate 25 also is formed integrally with the flange 19, which is disposed at the extreme outer portion of the end portion 26 of the cutter blades 23 toward which the pusher blades 8 move during a slicing operation of the food slicer 1. The plate 25 embodies a substantially flat, rectangular-shaped main body portion 27, with a lip 28 disposed at the end thereof remote from the flange 19 and projecting forwardly therefrom, at an obtuse angle thereto in downwardly spaced, closely adjacent relation to the free edge 23 of the main body portion 22 of the safety guard 17, FIGS. 1 and 6.

An elongated plate-like handle 29 is formed integrally with and projects from the free edge of the flange 24 of the main body portion 22. The handle 29 preferably is so disposed on the safety guard 17 that it projects downwardly and forwardly from the flange 24, when the safety guard 17 is disposed in normal, at-rest position, as shown in FIGS. 1 and 6, in laterally overlapping relation to the lip 28 and the adjacent edge portion of the main body portion 27 of the plate 25, for a purpose which will be discussed in greater detail hereinafter.

An elongated, plate-like finger 30 also is formed integrally with and projects from the free edge of the flange 24 of the main body portion 22 of the safety guard 17, at the end of the supporting frame 4 remote from plate 25, FIGS. 1 and 6. The finger 30 embodies an upper end portion 31, which projects downwardly and forwardly from the flange 24, and a free end portion 32, which projects substantially horizontally forwardly from the upper end portion 31, when the safety guard 17 is disposed in the aforementioned normal, at-rest position thereof, the free end portion 32 of the finger 30 terminating at its free edge, remote from the end portion 31 in an upwardly turned flange 33, FIG. 4.

The finger 30 is so disposed on the main body portion 22 of the safety guard 17 that when the latter is disposed in its aforementioned normal, at-rest position, it is effective to abuttingly engage the guard plate 12, for a purpose which will be discussed in greater detail presently, if the pusher unit 7 is moved inwardly from the position shown in FIG. 1 toward the position shown in FIG. 3, to thereby prevent the pusher blades 8 from engaging the main body portion 27 or the lip 28 of the plate 25.

In the operation of the food slicer 1, with the pusher unit 7 disposed in fully retracted, food-receiving position, as shown in FIG. 1, a tomato, or the like, to be sliced, may be placed in the recesses 16 of the pusher blades 8 either by dropping the same downwardly into the recesses or moving the same from left to right, as viewed in FIG. 1, parallel to the cutter blades 3 into the recesses 16. It will be seen that when the food is inserted into the recesses 16 in the latter manner, the body portion 27 of the plate 25 affords an effective protection against engagement of the operator's hand with the cutter blades 3, when the hand is disposed at the end portion 26 thereof, and, if, in placing the food into the recesses 16 the operator should move his hand in a direction toward the cutter blades 3, the lip 28, is effective to engage the hand and not only act as a reminder that the hand is too close to the cutter blades, but actually deflect the hand outwardly away from the cutter blades 3.

Figure 2:
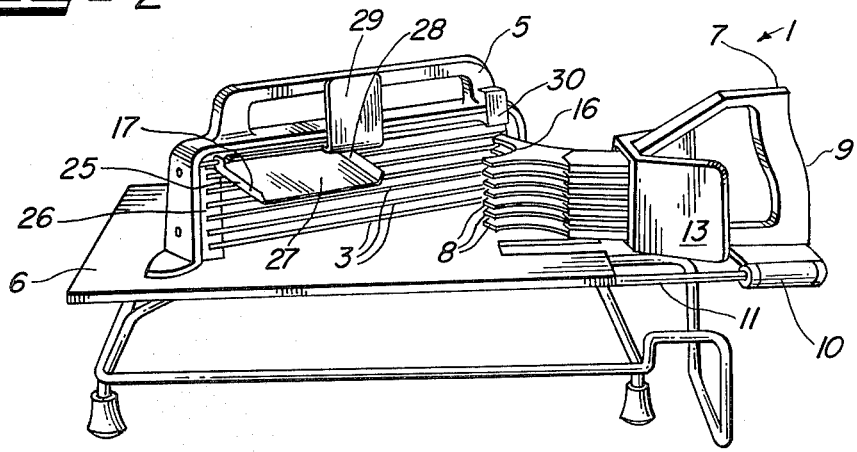
FIG. 2 is a view similar to FIG. 1, but showing the safety guard disposed in different operative position.

In the operation of the food slicer 1, after the food has thus been placed in the recesses 16 of the pusher blades 8, the operator may lift the handle 29 of the safety guard 17 upwardly with the fingers of one hand, such as, for example, his left hand, and hold the handle 29 in upwardly disposed position, as shown in FIG. 2, while grasping the handle 5 of the supporting frame 4 of the cutter unit 2 with the same hand. Such upward movement of the handle 29 is effective to rotate the safety guard 17 upwardly on the pins 21 into position to raise the plate 25 thereof above the path of travel of the cutter blades 8.

Thereafter, while the operator continues to grasp the handles 5 and 29 with one hand, he may grasp the handle 9 of the pusher unit 7 with the other hand, and move the latter rearwardly from the aforementioned forwardly projecting, food-receiving position, shown in FIG. 1, to the full rearwardly disposed, food-slicing position, shown in FIG. 3. Thereafter, the operator may move the handle 9 and, therefore, the pusher unit 7 back outwardly into the position shown in FIG. 1; release the handles 5 and 29 to thereby permit the safety guard 17 to move downwardly into its aforementioned, normal, at-rest position; pick up the slices of tomato on the upper face of the base 6; place another tomato into the recesses 16; again raise the safety guard 17; and repeat the above described slicing operation by again moving the pusher unit 7 into food-slicing position.

Food slicers of the general type of the food slicer 1, shown in the drawings, and embodying safety guards, which embodied structure corresponding to the main body portion 27 of the plate 25 and the handle 29 of the safety guard 17 have been heretofore known in the art. However, insofar as is known, no food slicer embodying a safety guard having the construction of the safety guard 17, and which includes the lip 28 and the finger 30, have been heretofore known in the art. As a result, the safety guards heretofore known in the art have not had the construction, nor the mode of operation of the safety guard 17.

As previously mentioned, this construction and mode of operation includes the embodiment of the lip 28 on the body portion 27 of the plate 25 to afford not only a reminder but an actual barrier to improper passage of a hand relative to the cutter blades 3.

Figure 4:
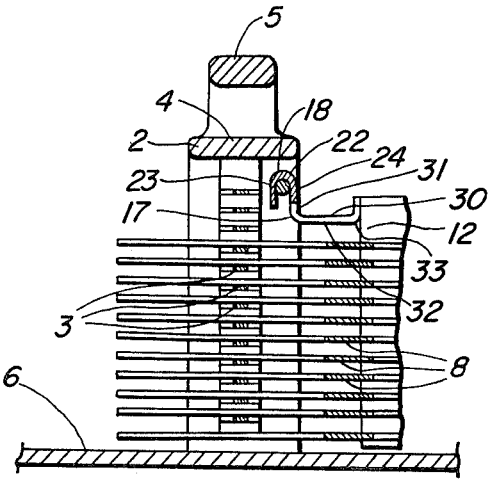
FIG. 4 is a fragmentary sectional view taken substantially along the line 4—4 in FIG. 5, but showing the safety guard and pusher unit disposed in a different position.

In addition, in the food slicer 1, the finger 30 is so constituted and arranged that if the pusher unit 7 should be accidentally, or otherwise, moved along a food-slicing path of travel, while the safety guard 17 remains in its aforementioned normal, at-rest position, as shown in FIG. 1, it will abuttingly engage the guard plate 12 of the pusher unit 7, FIGS. 4 and 5, to thereby stop the pusher blades 8 in forwardly spaced relation to the plate 25 and prevent the pusher blades 8 from engaging either the main body portion 27 or the lip 28 of the plate 25 and being gouged or otherwise damaged thereby.

From the foregoing it will be seen that the present invention affords a food slicer which embodies novel safety guard features.

In addition, it will be seen that the present invention affords a food slicer wherein a novel safety guard is constituted and arranged in a novel and expeditious manner therein.

Also, it will be seen that the present invention affords a food slicer which embodies a novel safety guard which is practical and efficient in operation and which may be readily and economically produced commercially.

Thus, while we have illustrated and described the preferred embodiment of our invention, it is to be understood that this is capable of variation and modification, and we therefore do not wish to be limited to the precise details set forth, but desire to avail outselves of such changes and alterations as fall within the purview of the following claims.

We claim:

1. In a manual food slicer embodying a supporting base, a cutter unit mounted on said base, said cutter unit including a stack of elongated, substantially horizontally extending, parallel, spaced cutter blades, and a pusher unit slidably mounted on said base for movement, at an acute angle to the length of said cutter blades, toward and away from said cutter unit into food-slicing and food-receiving positions, respectively, said pusher unit embodying a plurality of pusher blades movable along said cutter blades from one end portion to the other end portion of the latter into intermeshed relation to said cutter blades when said pusher unit is moved into said food-slicing position from said food-receiving position, said pusher blades being disposed in outwardly spaced relation to said cutter blades in position for receiving food to be sliced between said cutter blades and said pusher blades when said pusher unit is disposed in said food-receiving position, and a handle for manually moving said pusher unit between said food-slicing and said food-receiving positions, the combination of a. supporting means mounted on said cutter unit, and
b. an elongated guard rotatably mounted at its upper edge portion on said supporting means for rotation between a raised position and a lowered position,
c. said guard comprising
  (1) a plate disposed at one end thereof,
  (2) another handle disposed above said plate for manually moving said guard from said lowered position to said raised position thereof, and
  (3) an elongated finger disposed at the other end thereof,
d. said plate
  (1) being disposed
    (a) between said cutter blades and said pusher blades in covering relation to said other end portion of said cutter blades when said guard is disposed in said lowered position, and
    (b) above said pusher blades when said guard is disposed in said raised position, and
  (2) having a lip
    (a) on the edge thereof which faces toward said finger, and
    (b) projecting toward said pusher blades when said guard is disposed in said lowered position,
e. said other handle
  (1) projecting substantially horizontally from said plate and cutter blades when said guard is disposed in said lowered position, and
  (2) projecting upwardly from and above said plate and said cutter blades when said guard is disposed in said raised position, and
f. said finger projecting from said supporting means in position to abuttingly engage said pusher unit in position to prevent said pusher blades from engaging said lip when said pusher unit is moved from said food-receiving position toward said food-slicing position with said guard disposed in said lowered position.

2. The combination, in a food slicer, defined in claim 1, and in which said lip projects outwardly from said cutter blades, at an obtuse angle to said other end portion of said cutter blades when said guard is disposed in said lowered position.

3. The combination, in a food slicer, defined in claim 1, and in which a. said guard includes an upper edge portion rotatably mounted on said supporting means, and
b. said plate, said other handle and said finger are mounted on and project outwardly from said upper edge portion.

4. The combination, in a food slicer, defined in claim 3, and in which a. said finger is disposed at the far end of said cutter unit from said plate.

5. The combination in a food slicer, defined in claim 4, and in which a. said other handle comprises another plate, and b. said other plate is disposed on said upper edge portion in laterally overlapping relation to said first mentioned plate.

6. The combination, in a food slicer, defined in claim 5, and in which a. said other plate is disposed in laterally overlapping relation to said lip.

7. In a manual food slicer embodying a supporting base, a cutter unit mounted on said base, said cutter unit including a stack of elongated, substantially horizontally extending, parallel, spaced cutter blades, and a pusher unit slidably mounted on said base for movement, at an acute angle to the length of said cutter blades, toward and away from said cutter unit into food-slicing and food-receiving positions, respectively, said pusher unit embodying a plurality of pusher blades movable along said cutter blades from one end portion to the other end portion of the latter into intermeshed relation to said cutter blades when said pusher unit is moved into said food-slicing position from said food-receiving position, said pusher blades being disposed in outwardly spaced relation to said cutter blades in position for receiving food to be sliced between said cutter blades and said pusher blades when said pusher unit is disposed in said food-receiving position, a handle, at the side of said pusher blades remote from said cutter blades, for manually moving said pusher unit between said food-slicing and said food-receiving positions, and a guard plate flaring outwardly from said handle, between said handle and said cutter blades and in substantially parallel relation to the latter, the combination of a. supporting means mounted on said cutter unit, and b. an elongated guard rotatably mounted at its upper edge portion on said supporting means for rotation between a raised position and a lowered position, c. said guard comprising (1) a plate disposed at one end thereof, (2) another handle disposed above said plate for manually moving said guard from said lowered position to said raised position thereof, and (3) an elongated finger disposed at the other end thereof, d. said plate (1) being disposed (a) between the cutter blades and said pusher blades in covering relation to said other end portion of said cutter blades when said guard is disposed in said lowered position, and (b) above said pusher blades when said guard is disposed in said raised position, and (2) having a lip (a) on the edge thereof which faces toward said finger, and (b) projecting toward said pusher blades when said guard is disposed in said lowered position, e. said other handle (1) projecting substantially horizontally from said plate and cutter blades when said guard is disposed in said lowered position, and (2) projecting upwardly from and above said plate and said cutter blades when said guard is disposed in said raised position, and f. said finger projecting from said supporting means in position to abuttingly engage said guard plate in position to prevent said pusher blades from engaging said lip when said pusher unit is moved from said food-receiving position toward said food-slicing position with said guard disposed in said lowered position.

8. The combination, in a food slicer, defined in claim 7, and in which a. said finger comprises an elongted plate having (1) an upper end portion projecting downwardly and outwardly from said upper edge portion of said guard, and (2) a lower end portion projecting substantially horizontally outwardly away from the lower edge of said upper end portion and toward said pusher unit.

* * * * *